US011328661B2

(12) United States Patent
Lee et al.

(10) Patent No.: US 11,328,661 B2
(45) Date of Patent: May 10, 2022

(54) ELECTRONIC DEVICE INCLUDING DISPLAY AND METHOD FOR OPERATING THE SAME

(71) Applicant: Samsung Electronics Co., Ltd., Gyeonggi-do (KR)

(72) Inventors: Gwanghui Lee, Gyeonggi-do (KR); Seungjin Kim, Gyeonggi-do (KR); Minwoo Kim, Gyeonggi-do (KR); Seoyoung Lee, Gyeonggi-do (KR); Woojun Jung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/161,800

(22) Filed: Jan. 29, 2021

(65) Prior Publication Data

US 2021/0248957 A1 Aug. 12, 2021

(30) Foreign Application Priority Data

Feb. 10, 2020 (KR) ..... 10-2020-0015825

(51) Int. Cl.
*G09G 5/18* (2006.01)
*G09G 3/3225* (2016.01)

(52) U.S. Cl.
CPC ..... *G09G 3/3225* (2013.01); *G09G 2320/041* (2013.01); *G09G 2360/12* (2013.01)

(58) Field of Classification Search
CPC ..... G09G 2340/0435; G09G 2310/08; G09G 2330/021; G09G 2320/0247; G09G 2320/0626; G09G 2320/0252; G09G 2320/0261; G09G 2360/12; G09G 2360/16; G09G 5/005; G09G 2310/04; G09G 2320/0257; G09G 2320/0209; G09G 2320/0266; G09G 2310/061; G09G 2320/041; G09G 2320/06; G09G 2320/0693; G09G 3/20; G09G 3/3208; G09G 3/3225
See application file for complete search history.

(56) References Cited

U.S. PATENT DOCUMENTS 9,524,694 B2 * 12/2016 Wang ..... G09G 5/001
2003/0156074 A1 * 8/2003 Ranganathan ..... G06F 3/1431 345/1.1

(Continued)

FOREIGN PATENT DOCUMENTS

CN 110619860 A 12/2019
GB 2 378 343 A 5/2003

(Continued)

OTHER PUBLICATIONS

International Search Report dated May 24, 2021.

*Primary Examiner* — Duc Q Dinh
(74) *Attorney, Agent, or Firm* — Cha & Reiter, LLC

(57) ABSTRACT

In accordance with certain embodiments, an electronic device comprises: a memory; a display; and a processor operatively connected with the memory, wherein the processor is configured to: identify a target refresh rate and a current refresh rate of the display; and change the refresh rate of the display to a first refresh rate between the current refresh rate and the target refresh rate before changing the refresh rate of the display to the target refresh rate.

20 Claims, 17 Drawing Sheets

(56) References Cited

U.S. PATENT DOCUMENTS

| | | | | |
|---|---|---|---|---|
| 2013/0265294 | A1* | 10/2013 | Kim | G09G 3/3611 345/214 |
| 2015/0248873 | A1* | 9/2015 | Tanaka | G09G 5/18 345/213 |
| 2015/0339994 | A1* | 11/2015 | Verbeure | G09G 3/2044 345/214 |
| 2016/0125785 | A1 | 5/2016 | Wang et al. | |
| 2016/0196802 | A1 | 7/2016 | Nho et al. | |
| 2017/0263201 | A1 | 9/2017 | Sato et al. | |
| 2018/0158418 | A1 | 6/2018 | Ryu et al. | |
| 2018/0261191 | A1* | 9/2018 | Yi | G09G 5/14 |
| 2018/0350313 | A1* | 12/2018 | Nambi | G09G 3/3611 |
| 2020/0074583 | A1* | 3/2020 | Holland | G06T 1/20 |

FOREIGN PATENT DOCUMENTS

| | | | |
|---|---|---|---|
| KR | 10-2015-0134772 | A | 12/2015 |
| KR | 10-2017-0098119 | A | 8/2017 |
| KR | 10-2018-0065194 | A | 6/2018 |
| WO | 2016/053539 | A1 | 4/2016 |

* cited by examiner

| | BRIGHTNESS DIFFERENCE PRIORITIZED | RESPONSIVENESS PRIORITIZED |
|---|---|---|
| INTERMEDIATE FREQUENCY SUBDIVISION | INCREASE | DECREASE |
| DURATION OF INTERMEDIATE FREQUENCY | INCREASE | DECREASE |

FIG.10

ELECTRONIC DEVICE INCLUDING DISPLAY AND METHOD FOR OPERATING THE SAME

CROSS-REFERENCE TO RELATED APPLICATION(S)

This application is based on and claims priority under 35 U.S.C. 119 to Korean Patent Application No. 10-2020-0015825, filed on Feb. 10, 2020, in the Korean Intellectual Property Office, the disclosure of which is herein incorporated by reference in its entirety.

BACKGROUND

Field

Certain embodiments of the disclosure relate to electronic devices having a display and methods for operating the same.

Description of Related Art

In recent years, electronic devices include various displays. The displays may include active organic light emitting diode (AMOLED) displays as well as liquid crystal displays (LCDs) to provide a natural image or screen.

Electronic devices may dynamically adjust the refresh rate to provide a more natural-appearing image. For example, an electronic device may adjust the refresh rate by adjusting the V-Blank period suggested in the 'VESA DISPLAY PORT 1.2a ADAPTIVE-SYNC' standard. The V-Blank period is a time delay between the last line of a field or frame and a first visible line of the subsequent field or frame. Specifically, the electronic device may change the delay of images displayed on the display by varying the V-Blank. up to the maximum up to the maximum.

With dynamic adjustments of the refresh rate, it is important no changes to the brightness of the display be visible to the user.

The above information is presented as background information only to assist with an understanding of the disclosure. No determination has been made, and no assertion is made, as to whether any of the above might be applicable as prior art with regard to the disclosure.

SUMMARY

In accordance with certain embodiments, an electronic device comprises: a memory; a display; and a processor operatively connected with the memory, wherein the processor is configured to: identify a target refresh rate and a current refresh rate of the display; and change the refresh rate of the display to a first refresh rate between the current refresh rate and the target refresh rate before changing the refresh rate of the display to the target refresh rate.

In accordance with certain embodiments, a method comprises: identifying a target refresh rate and a current refresh rate of a display; and changing the refresh rate of the display to a first refresh rate between the current refresh rate and the target refresh rate before changing the refresh rate of the display to the target refresh rate.

In accordance with certain embodiments, an electronic device comprises: a memory; a display; and a processor operatively connected with the memory, wherein the processor is configured to: identify whether a state of the electronic device is included in a condition for changing a refresh rate of the display; when the state of the electronic device is included in the change condition, identify a target refresh rate corresponding to the change condition and a current refresh rate of the display; change the refresh rate of the display to a first refresh rate between the current refresh rate and the target refresh rate; and change the first refresh rate to the target refresh rate after the refresh rate of the display is changed to the first refresh rate.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

A more complete appreciation of the disclosure and many of the attendant aspects thereof will be readily obtained as the same becomes better understood by reference to the following detailed description when considered in connection with the accompanying drawings, wherein:

FIG. 10 is a view illustrating the operation of determining a speed of switching to a target refresh rate by an electronic device according to an embodiment;

Throughout the drawings, like reference numerals will be understood to refer to like parts, components, and structures.

DETAILED DESCRIPTION

Figure 1:
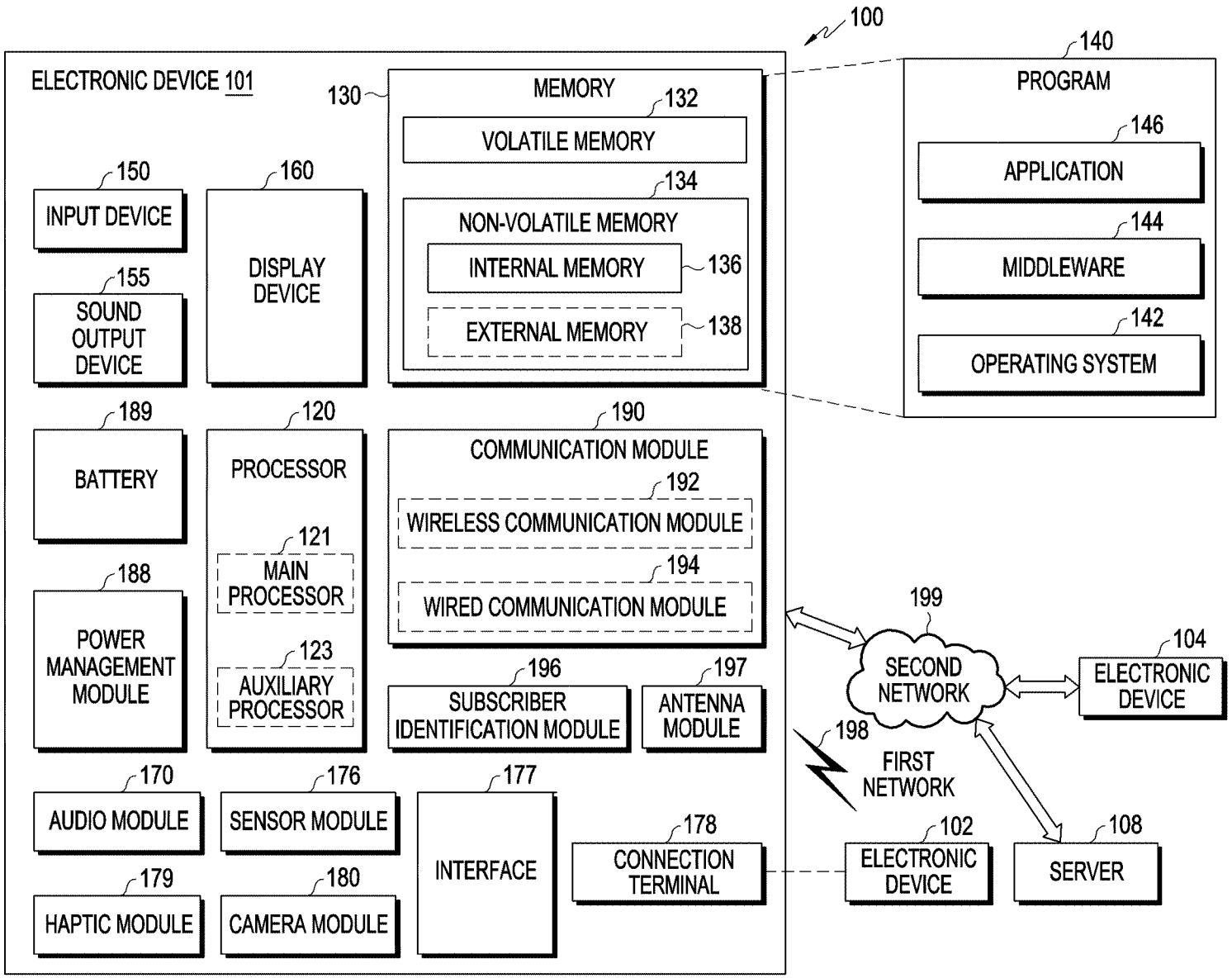
FIG. 1 is a block diagram illustrating an electronic device in a network environment according to an embodiment.

FIG. 1 describes an electronic device 101 with a display device 160. The display device 160. The display device 160 may include active organic light emitting diode (AMOLED)

displays as well as liquid crystal displays (LCDs) to provide a natural-appearing image. To provide a more natural-appearing image, the electronic device 101 may adjust the refresh rate of the display device 160 by adjusting the V-Blank period suggested in the 'VESA DISPLAY PORT 1.2a ADAPTIVE-SYNC' standard. Specifically, the electronic device may change the delay of images displayed on the display by varying "V-Blank."

According to certain embodiments, the electronic device 101 and methods described herein, may reduce differences in screen brightness or color resulting from changing the refresh rate of the display.

The electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

As used herein, the term "processor" shall refer to both the singular and plural contexts.

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 1301, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or motion) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 388 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device). According to an embodiment, the antenna module may include one antenna including a radiator formed of a conductor or conductive pattern formed on a substrate (e.g., a printed circuit board (PCB)). According to an embodiment, the antenna module 197 may include a plurality of antennas. In this case, at least one antenna appropriate for a communication scheme used in a communication network, such as the first network 198 or the second network 199, may be selected from the plurality of antennas by, e.g., the communication module 190. The signal or the power may then be transmitted or received between the communication module 190 and the external electronic device via the selected at least one antenna. According to an embodiment, other parts (e.g., radio frequency integrated circuit (RFIC)) than the radiator may be further formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to certain embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that certain embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program products may be traded as commodities between sellers and buyers. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

Figure 2:
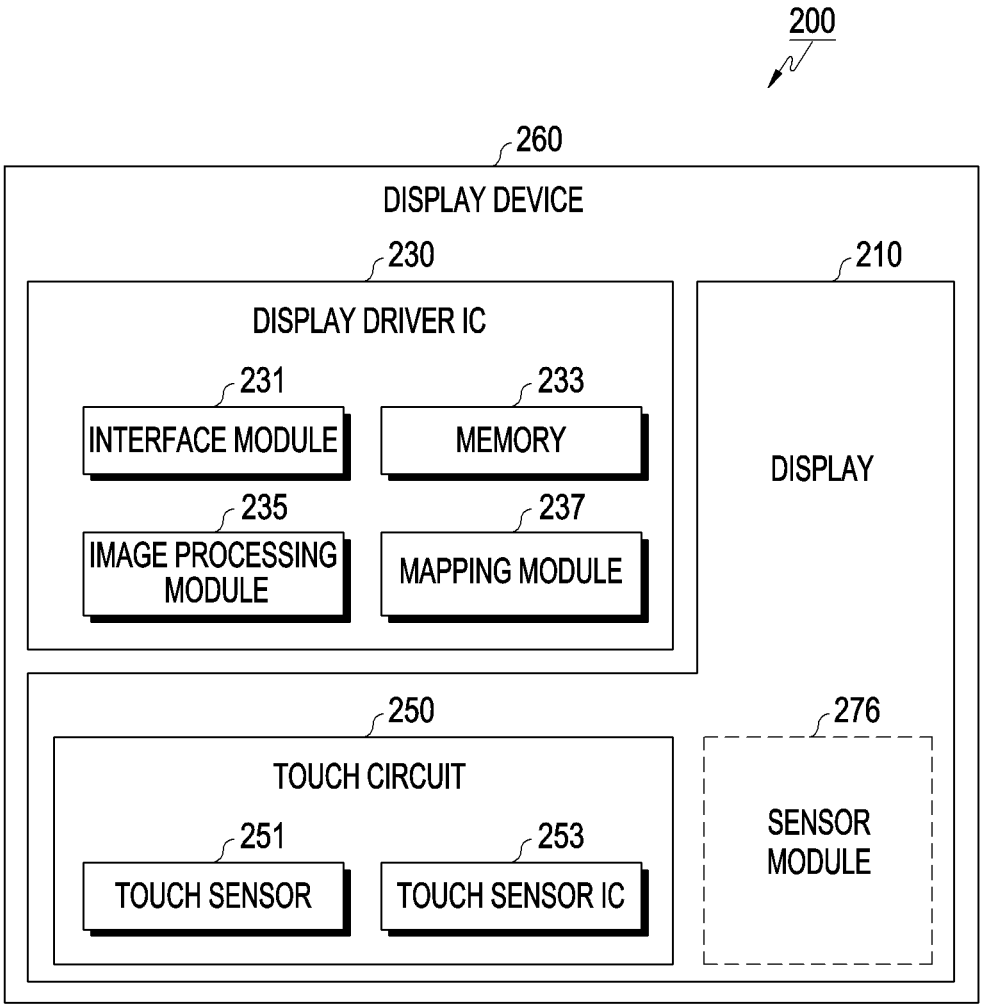
FIG. 2 is a block diagram illustrating a display device according to an embodiment.

FIG. 2 is a block diagram 200 illustrating the display device 160 according to an embodiment. Referring to FIG. 2, the display device 160 may include a display 210 and a display driver integrated circuit (DDI) 230 to control the display 110. The DDI 230 may include an interface module 231, memory 233 (e.g., buffer memory), an image processing module 235, or a mapping module 237. The DDI 230 may receive image information that contains image data or an image control signal corresponding to a command to control the image data from another component of the electronic device 101 via the interface module 231. For example, according to an embodiment, the image information may be received from the processor 120 (e.g., the main processor 121 (e.g., an application processor)) or the auxiliary processor 123 (e.g., a graphics processing unit) operated independently from the function of the main processor 121. The DDI 230 may communicate, for example, with touch circuitry 250 or the sensor module 176 via the interface module 231. The DDI 230 may also store at least part of the received image information in the memory 233, for example, on a frame by frame basis. The image processing module 235 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 210. The mapping module 237 may generate a voltage value or a current value corresponding to the image data pre-processed or post-processed by the image processing module 135. According to an embodiment, the generating of the voltage value or current value may be performed, for example, based at least in part on one or more attributes of the pixels (e.g., an array, such as an RGB stripe or a pentile structure, of the pixels, or the size of each subpixel) of the display 210. At least some pixels of the display 210 may be driven, for example, based at least in part on the voltage value or the current value such that visual information (e.g., a text, an image, or an icon) corresponding to the image data may be displayed via the display 210.

According to an embodiment, the display device 160 may further include the touch circuitry 250. The touch circuitry 250 may include a touch sensor 251 and a touch sensor IC 253 to control the touch sensor 151. The touch sensor IC 253 may control the touch sensor 251 to sense a touch input or a hovering input with respect to a certain position on the display 210. To achieve this, for example, the touch sensor IC 253 may detect (e.g., measure) a change in a signal (e.g., a voltage, a quantity of light, a resistance, or a quantity of one or more electric charges) corresponding to the certain position on the display 210. The touch sensor IC 253 may provide input information (e.g., a position, an area, a pressure, or a time) indicative of the touch input or the hovering input detected to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 250)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment, the touch sensor 251 or the sensor module 176 may be disposed between pixels in a pixel layer of the display 210, or over or under the pixel layer.

As used herein, the term "refresh rate" may mean, or be interchangeably used with, a frame rate, frame per second (fps), refresh rate, and scanning rate. As used herein, when the refresh rate is changed, it may mean that the frequency or frequency value indicating the refresh rate is changed.

Figure 3:
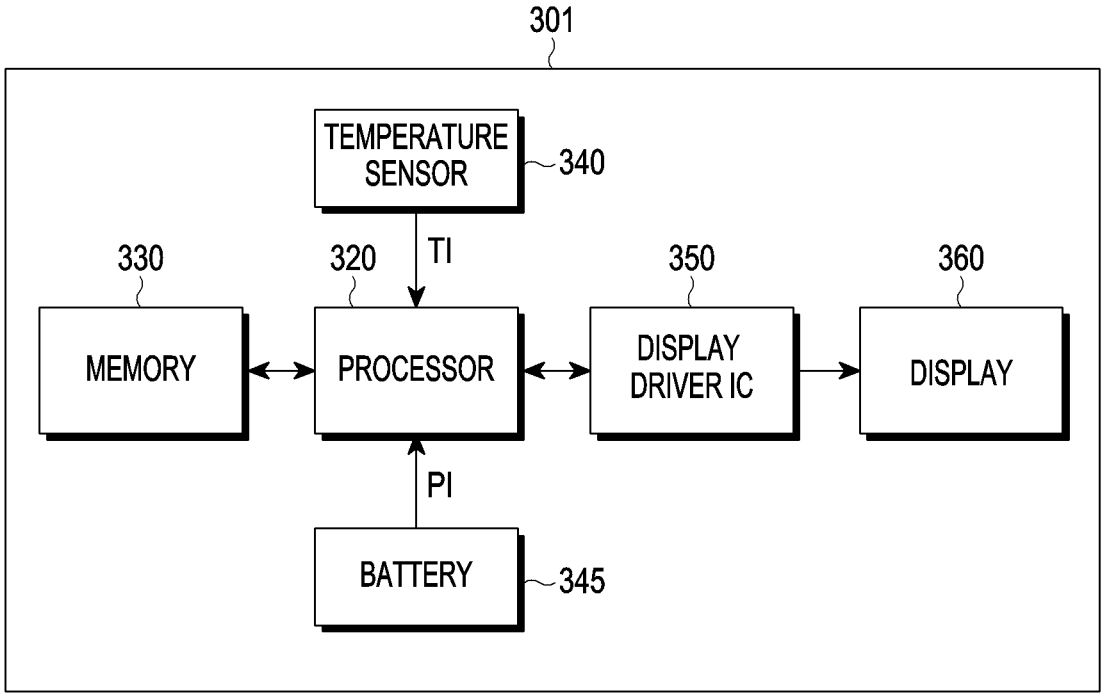
FIG. 3 is a block diagram schematically illustrating an electronic device according to an embodiment.

FIG. 3 is a block diagram schematically illustrating an electronic device 301 according to an embodiment. The processor 320 may provide a more natural-appearing images on the display 360 by dynamically changing the refresh rate. Additionally, the processor 320 can also change the refresh rate based on temperature information TI from the temperature sensor 340 or the power information PI from the battery 345. Upon detecting a condition for changing the refresh rate, the processor 320 may determine or identifies a target refresh rate. The processor 320 can then changes the refresh rate from a current refresh rate to an intermediate refresh rate, and from the intermediate refresh rate to the target refresh rate. The foregoing reduces the perceptibility in changes of color or brightness of the display 360.

In certain embodiments, the electronic device 301 can include a memory 330. The memory 330 stores frequency change paths. The processor 320 can change the frequency by selecting a first frequency path that changes the frequency from the current refresh rate to an intermediate refresh frequency and a second frequency path that changes the refresh rate from the intermediate refresh frequency to the target refresh frequency.

The electronic device 301 may include a processor 320, a memory 330, a temperature sensor 340, a battery 345, a display driver integrated circuit (IC) 350, and a display 360.

The electronic device 301 may be implemented to be substantially the same or similar to the electronic device 101 or 102 of FIG. 1.

The processor 320 may control the overall operation of the electronic device 301. For example, the processor 320 may display images (or frames) through the display 360.

The processor 320 may render an image (or frame) and transmit the rendered image (or frame) to the display 360 through the display driver IC 350. For example, the processor 320 may display the rendered image (or frame) through the display 360.

The processor 320 may control the refresh rate of the display 360. For example, the processor 320 may adjust the refresh rate of the display 360 within a predetermined frequency range. For example, the processor 320 may increase or decrease the refresh rate by adjusting the V-Blank period suggested in the 'VESA DISPLAY PORT 1.2a ADAPTIVE-SYNC' standard. The V-Blank period is the time delay between presentation of the last line of a field or frame and the first line of a subsequent field or frame. For example, the processor 320 may vary the V-Blank up to the maximum V-Blank period supported by the display 360. When the V-Blank period increases, the refresh rate of the rendered image may decrease as the V-Sync period increases. In addition, when the V-Blank period is decreased, the refresh rate of the rendered image may increase as the V-Sync period is shortened.

The processor 320 may detect a condition for changing the refresh rate. For example, when a designated application is requested to be executed or is executed, the processor can identify that the refresh rate is to be changed. Additionally, the processor 320 may detect that the refresh rate is to be changed when the running application is changed. For another example, the processor 320 may detect that the refresh rate of the display 360 is to be changed to a target refresh rate designated or set for each application. The processor 320 may change the refresh rate of the display 360 to the target refresh rate designated for a designated function when the execution of the designated function of the running application is requested or when the designated function is executed. For example, the processor 320 may provide a control signal for requesting a change to the target refresh rate to the display driver IC 350 or the display 360.

The processor 320 may identify whether the state of the electronic device 301 is included in conditions for changing the refresh rate. For example, when the application is switched from the background to foreground, the processor 320 may identify (or determine/detect) that the state of the electronic device is included in the conditions for changing the refresh rate.

A condition for changing the refresh rate can be deemed to be detected when a request is received for performing a function or executing an application that will result in a change in refresh rate. For example, the processor 320 can maintain a list of applications or functions that will result in a change in refresh rate. When a request for one of the functions or applications on the list is received, the processor 320 detects a condition for changing the refresh rate.

The processor 320 may change (e.g., decrease) the refresh rate of the display 360 in consideration of the temperature and/or power state of the electronic device 301. Alternatively, the processor 320 may change (e.g., decrease) the refresh rate of the display 360 when there is no screen update of the display 360. Conversely, the processor 320 may change (e.g., increase) the refresh rate when there is an update of the screen of the display 360 every predetermined period.

The processor 320 may identify the target refresh rate and current refresh rate corresponding to detecting of the condition for changing the refresh rate.

The processor 320 may change the refresh rate of the display 360 to an intermediate refresh rate between the current refresh rate and the target refresh rate prior to changing the refresh rate to the target refresh rate, based on the timing of transmission of the rendered image to the display 360. The processor 320 may change the intermediate refresh rate to the target refresh rate through at least one frequency changing step. In this case, the processor 320 may set the operation frequency (or clock frequency) of the processor 320 and the bandwidth of the memory 330 to the maximum until the target frequency is reached to suppress the occurrence of a frame drop.

A frequency changing step may be understood to be a discrete step. In certain embodiments, a frequency changing step of changing the refresh rate from a current refresh rate to an intermediate refresh rate, followed by successive frequency changing step of changing the intermediate refresh rate to the target refresh rate may include maintaining the refresh rate at the intermediate refresh rate for a period of time such that the rate of change is discontinuous becomes discontinuous at the intermediate refresh rate. In certain embodiments, the period of time may be for the display of one or more fields or frames.

Thus, the electronic device 301 may reduce an abrupt difference in brightness (or color) according to the change in the refresh rate by changing the refresh rate of the display 360 to the target refresh rate via the intermediate refresh rate.

In certain embodiments, the processor 320 may acquire temperature information (TI) about the electronic device 301 through at least one temperature sensor 340. For example, the processor 320 may identify whether the temperature TI of the electronic device 301 exceeds a predetermined temperature. For example, the temperature TI of the electronic device 301 may be a representative temperature value determined based on a plurality of temperature values obtained from the plurality of temperature sensors or temperature values obtained for a predetermined period of time. When the temperature TI of the electronic device 301 exceeds the predetermined temperature, the processor 320 may decrease the refresh rate of the display 360.

In certain embodiments, the processor 320 may obtain power information (PI) about the battery 345. For example, the processor 320 may identify the state of charge (SOC) stored in the battery 345 in real time or periodically. For example, the processor 320 may indirectly identify the amount of power through a power gauge IC capable of identify the SOC value and the battery 345. When the amount of power stored in the battery 345 is less than a predetermined value, the processor 320 may reduce the refresh rate of the display 360. The processor 320 may identify the power (or current) consumed by the electronic device 301. The processor 320 may reduce the refresh rate of the display 360 when the power (or current) consumed by the electronic device 301 exceeds the predetermined value.

The memory 330 may store data and/or information about the electronic device 301. For example, the memory 330 may be implemented to be substantially the same or similar to the memory 130 of FIG. 1. For example, the memory 330 may store information on a path for changing the refresh rate. For example, the path for changing the refresh rate may be a path for changing the frequency from the current refresh rate to the target refresh rate. In this case, the frequency change path may include at least one frequency value between the current refresh rate and the target refresh rate.

The processor 320 may identify the intermediate refresh rate between the current refresh rate and the target refresh rate based on information about the frequency change path from the current refresh rate to the target refresh rate stored in the memory 330. For example, the processor 320 may identify intermediate frequency values that are undergone until the current refresh rate is changed to the target refresh rate is changed, based on the information about the frequency change path.

The display driver IC 350 may be implemented to be the same or similar to the display driver IC 230 of FIG. 2. The display driver IC 350 may control the display 360 under the control of the processor 320. For example, the rendered image received from the processor 320 may be transmitted to the display 360.

The display 360 may be implemented to be the same or similar to the display 210 of FIG. 2. The display 360 may scan and display the rendered image received from the display driver IC 350. For example, the display 360 may include an organic light emitting diode (OLED) display and/or an active matrix organic light emitting diode (AMOLED) display.

Figure 4:
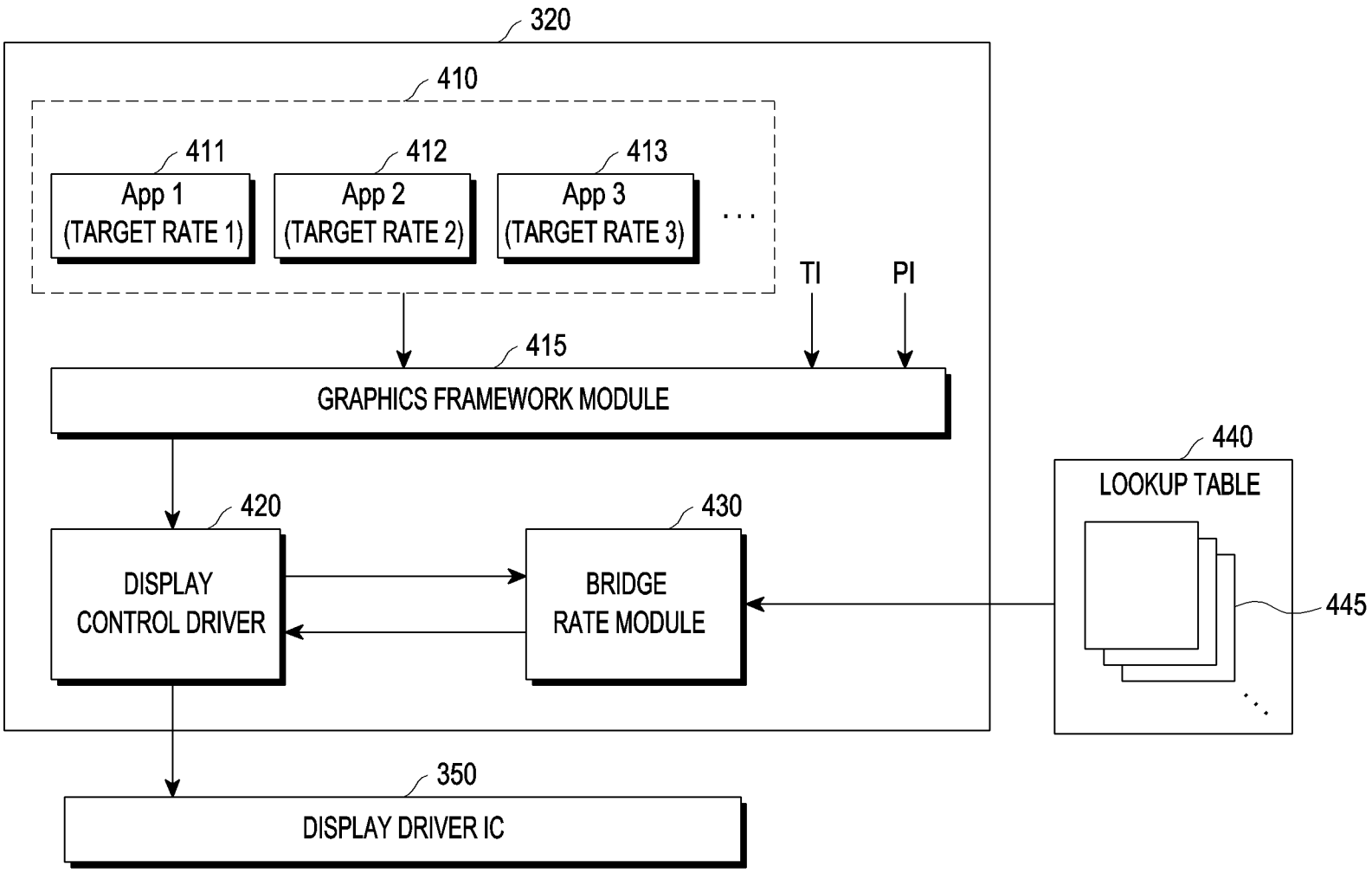
FIG. 4 is a block diagram illustrating the operation of changing a refresh rate by an electronic device according to an embodiment.

FIG. 4 is a block diagram illustrating the operation of changing a refresh rate by an electronic device according to an embodiment. A graphics framework module 415 receives temperature information (TI), power information (PI), and notification of execution of applications 411, 412, and 413. Based on the foregoing, the graphics framework module 415 can detect a condition for changing a refresh rate from a current refresh rate to an intermediate refresh rate. The graphics framework module 415 provides a request to change the refresh rate from the current refresh rate to the target refresh rate to the display control driver 420. The display control driver 420 receives an intermediate refresh rate from the bridge rate module 430. The bridge rate module 430 accesses a lookup table 445 that can be stored in memory, for example, memory 330. The memory 430 stores frequency change paths. Based on the frequency change paths, the bridge rate module 430 determines the intermediate refresh rate and provides the intermediate refresh rate to the display control driver 420. The display control driver 420 applies the intermediate refresh rate to the display driver IC 350 and subsequently applies the target refresh rate to the display driver IC 350.

Referring to FIG. 4, a processor 320 (e.g., the processor 120 of FIG. 1) may execute a graphics framework module 415, a display control driver 420, and a bridge rate module 430. For example, the graphics framework module 415, the display control driver 420, and the bridge rate module 430 may be programs executed by the processor 320. Alternatively, some functions of the graphics framework module 415, the display control driver 420, and the bridge rate module 430 may be implemented in hardware included in the processor 320.

Meanwhile, although FIG. 4 shows the graphics framework module 415, the display control driver 420, and the bridge rate module 430 as separate modules, this is so done only for convenience of description, and the technical spirit of the disclosure is not limited thereto. For example, the graphics framework module 415, the display control driver 420, and the bridge rate module 430 may be implemented as a single module. Alternatively, the graphics framework module 415, the display control driver 420, and the bridge rate module 430 may be implemented as more subdivided modules.

The graphics framework module 415, the display control driver 420, and the bridge rate module 430 may be stored in the memory 330 (for example, the memory 130 of FIG. 1) and executed by the processor 320.

When a designated application is executed, the graphics framework module 415 may identify the target refresh rate designated for the corresponding application. For example, the graphics framework module 415 may identify which application among the plurality of applications 410 stored in the memory 330 is executed in the foreground, and may identify the target refresh rate designated for the corresponding application. For example, a target refresh rate may be designated for each of the plurality of applications 410 stored in the memory 330. For example, as the target refresh rate, a first target rate, a second target rate, and a third target rate may be designated for a first application 411, a second application 412, and a third application 413, respectively.

Each target rate value may be automatically set by the processor 320 or may be set manually by the user.

The graphics framework module 415 may receive temperature information TI and/or power information PI. The graphics framework module 415 may also receive other information. For example, the other information may include information about a performance limitation for a specific application and/or a performance limitation for a specific function.

The graphics framework module 415 may determine the target refresh rate of the display (e.g., the display 360 of FIG. 3) based on at least one of the target refresh rate, temperature information (TI), power information (PI), and other information of an application that is requested to be executed or is being executed. For example, when the temperature of the electronic device 301 does not exceed a predetermined temperature, and the amount of power included in the battery (e.g., the battery 345 of FIG. 3) of the electronic device 301 is more than a predetermined value, the graphics framework module 415 may determine that the target refresh rate of the application is the target refresh rate of the display 360. When the temperature of the electronic device 301 exceeds the predetermined temperature, or when the amount of power included in the battery 345 of the electronic device 301 is less than the predetermined value, the graphics framework module 415 may determine that a frequency lower than the target refresh rate of the application is the target refresh rate of the display 360.

The graphics framework module 415 may determine a target refresh rate corresponding to a predetermined function or a predetermined event when the predetermined function is performed or the predetermined event occurs (e.g., browser scroll). For example, when a scroll occurs while the browser (or browser application) is running (or when a scroll input is detected), the target refresh rate of the display 360 may be determined based on at least one of the target refresh rate, temperature information (TI), power information (PI), and other information for the occurrence of the scroll. For example, when the temperature of the electronic device 301 does not exceed a predetermined temperature, and the amount of power included in the battery (e.g., the battery 345 of FIG. 3) of the electronic device 301 is more than a predetermined value, the graphics framework module 415 may determine that the target refresh rate corresponding to the occurrence of the scroll is the target refresh rate of the display 360. For example, when the temperature of the electronic device 301 exceeds the predetermined temperature, or when the amount of power included in the battery 345 of the electronic device 301 is less than the predetermined value, the graphics framework module 415 may determine that a frequency lower than the target refresh rate corresponding to the occurrence of the scroll is the target refresh rate of the display 360.

The graphics framework module 415 may request the display control driver 420 to change the refresh rate of the display 360 to the determined target refresh rate of the display 360.

The display control driver 420 may send a request for an intermediate refresh rate (or bridge frequency) to the bridge rate module 430 to change the refresh rate of the display 360 to the determined target refresh rate in response to the request for changing the refresh rate of the display 360.

The bridge rate module 430 may identify the intermediate refresh rate (or bridge frequency) for the target refresh rate by using a lookup table 440. For example, the intermediate refresh rate may be a frequency between the current refresh rate and the target refresh rate.

The lookup table 440 may include information 445 about a frequency change path until the target refresh rate is reached. The frequency change path may include frequencies undergone until the current refresh rate is changed to the target refresh rate. Further, the lookup table may include information about parameters for changing the refresh rate to each of the corresponding frequencies.

The lookup table 440 may be stored in the memory 330. The information about the frequency change path included in the lookup table 440 may be previously determined. The information about the frequency change path included in the lookup table 440 may be updated. The information about the frequency change path included in the lookup table 440 may be customized by the user. For example, when the refresh rate of the display 360 is changed based on the information about the frequency change path and a screen is output, the user may input feedback on whether the screen output state is natural. The processor 320 may maintain or adjust an intermediate frequency value included in the frequency change path based on the feedback result.

The bridge rate module 430 may determine (or identify) the intermediate refresh rate (or bridge frequency) via the frequency change path for the target refresh rate obtained from the lookup table 440. The bridge rate module 430 may apply the determined (or identified) intermediate refresh rate to the display driver IC 350. For example, as the intermediate refresh rate, a frequency closest to the image update timing may be selected.

The display driver IC 350 may change the refresh rate of the display 360 to the intermediate refresh rate (or bridge frequency).

Figure 5:
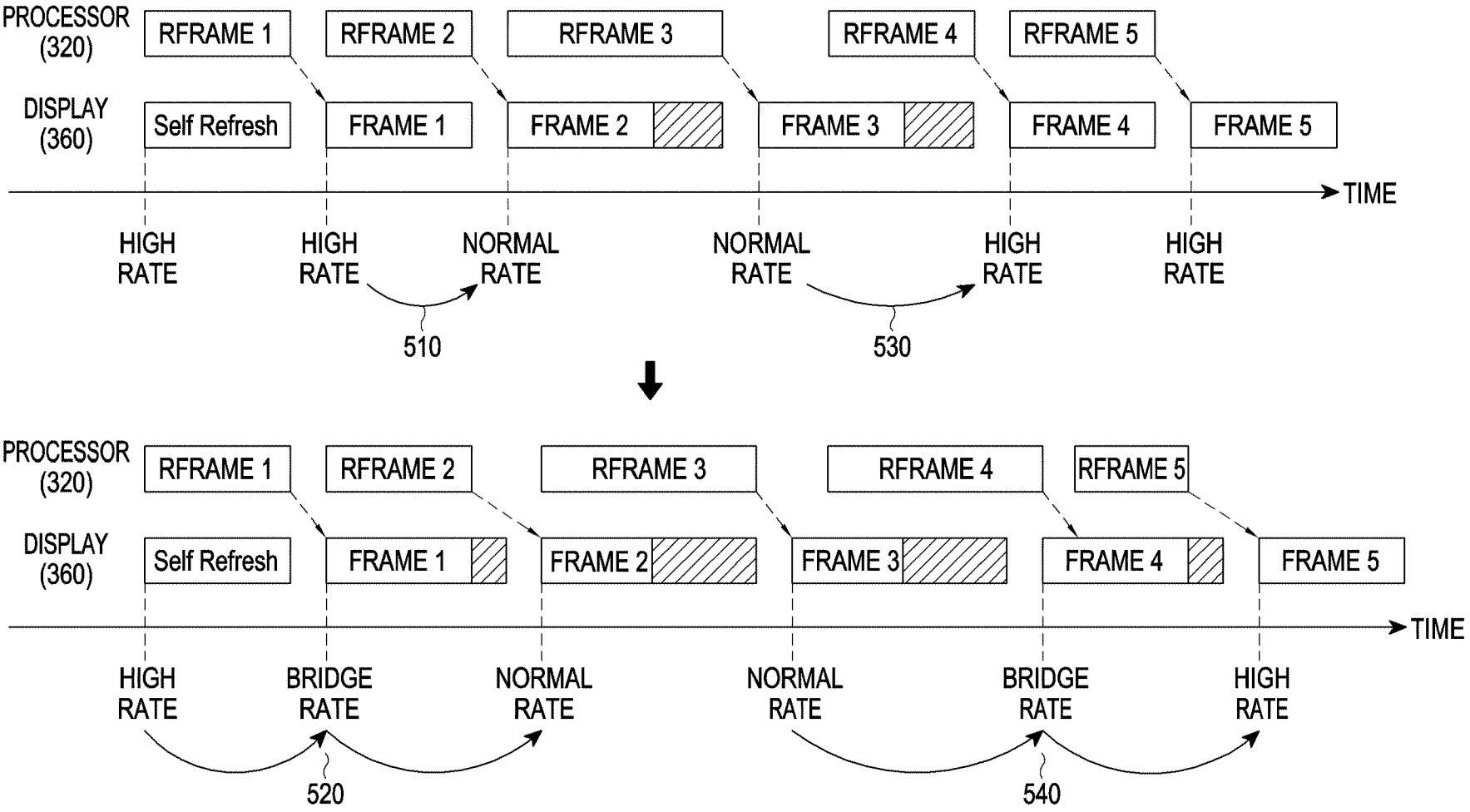
FIG. 5 is a view illustrating the operation of changing a refresh rate by an electronic device according to an embodiment.

FIG. 5 is a view illustrating the operation of changing a refresh rate by an electronic device according to an embodiment.

Referring to FIG. 5, the processor 320 may render a frame (or image). For example, the processor 320 may provide the rendered frame (RFRAME1, RFRAME2, RFRAME3, RFRAME4, or RFRAME5) to the display 360. The display 360 may scan the rendered frame (RFRAME1, RFRAME2, RFRAME3, RFRAME4, or RFRAME5) received from the processor 320 and display the frame (FRAME1, FRAME2, FRAME3, FRAME4, or FRAME5).

[MD1]In operation 510, the processor 320 may change the refresh rate of the display 360 form a "HIGH rate" to a "NORMAL rate" based on the timing of transmitting the rendered second frame RFRAME2 to the display 360. In this case, when the second frame FRAME2 is scanned by the display 360, the processor 320 may change the refresh rate to the "NORMAL rate".

In operation 520, the processor 320 may change the refresh rate of the display 360 form the "HIGH rate" to the "NORMAL rate" regardless of the timing of transmitting the rendered second frame RFRAME2 to the display 360. For example, when the condition for changing the refresh rate is detected, the processor 320 may start the operation of changing the refresh rate. When the request for changing the refresh rate is identified while the first frame FRAME1 is being rendered, the processor 320 may start changing the refresh rate and scan the first frame FRAME1 at a "BRIDGE rate". In this case, the "BRIDGE rate" may be a rate between the "HIGH rate" and the "NORMAL rate". Thereafter, the processor 320 may change the refresh rate from the "BRIDGE rate" to the "NORMAL rate". For example, the processor 320 may scan the second frame FRAME1 at the "NORMAL rate".

In operation 530, the processor 320 may change the refresh rate of the display 360 form the "NORMAL rate" to the "HIGH rate" based on the timing of transmitting the rendered fourth frame RFRAME4 to the display 360. In this case, when the fourth frame FRAME4 is scanned by the display 360, the processor 320 may change the refresh rate to the "HIGH rate".

In operation 540, the processor 320 may change the refresh rate of the display 360 form the "NORMAL rate" to the "HIGH rate" regardless of the timing of transmitting the rendered fourth frame RFRAME4 to the display 360. For example, when the request for changing the refresh rate is identified, the processor 320 may start the operation of changing the refresh rate. For example, when the request for changing the refresh rate is identified while the fourth frame FRAME4 is being rendered, the processor 320 may start changing the refresh rate and scan the fourth frame FRAME4 at the "BRIDGE rate". Thereafter, the processor 320 may change the refresh rate from the "BRIDGE rate" to the "HIGH rate". For example, the processor 320 may scan the fifth frame FRAME5 at the "HIGH rate".

The foregoing may reduce the visibility of differences in brightness due changes in refresh rate by adding the operation of changing to the intermediate refresh rate before changing the refresh rate of the display 360 to the target refresh rate.

The number of rendered and scanned frames shown in FIG. 5 is merely an example for convenience of description, and the scope of the disclosure is not be limited thereto. The processor 320 may change the refresh rate of the display 360 even when there is no frame to be rendered. For example, even when there is no frame to be rendered, the processor 320 may change the refresh rate while displaying the same frame on the display 360.

At least some of the operations performed by the electronic device 301 may be performed by the processor 320. In the following description, for convenience of description, it is assumed that the electronic device 301 is the entity that performs the operations.

Figure 6:
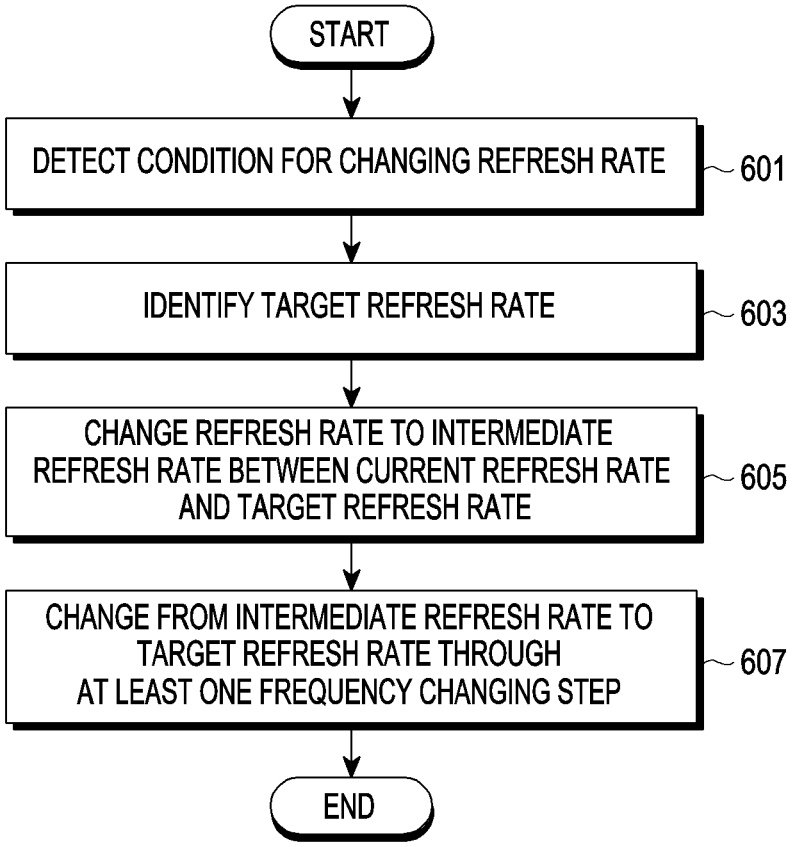
FIG. 6 is a flowchart illustrating the operation of changing a refresh rate by an electronic device according to an embodiment.

FIG. 6 is a flowchart illustrating the operation of changing a refresh rate by an electronic device according to an embodiment.

Referring to FIG. 6, according to certain embodiments, in operation 601, an electronic device (e.g., the electronic device 301 of FIG. 3) may detect a condition for changing the refresh rate of a display (display 360 of FIG. 3).

In operation 603, the electronic device 301 may identify a target refresh rate corresponding to the change request. The electronic device 301 may also identify the current refresh rate.

In operation 605, the electronic device 301 may change the refresh rate of the display 360 to an intermediate refresh rate between the current refresh rate and the target refresh rate. In this case, the frequency of the intermediate refresh rate and the duration thereof may be determined in consideration of reduction in brightness difference and responsiveness.

In operation 607, the electronic device 301 may change the refresh rate of the display 360 from the intermediate refresh rate to the target refresh rate through at least one frequency changing step. For example, the electronic device 301 may change the intermediate refresh rate directly to the target refresh rate. Alternatively, the electronic device 301 may change the intermediate refresh rate to another intermediate refresh rate (e.g., a rate between the intermediate refresh rate and the target refresh rate).

As the number of frequency changing steps increases, the difference in brightness may decrease. However, as the number of frequency changing steps increases, more time is required to reach the target refresh rate, and thus the responsiveness may decrease. Accordingly, the electronic device 301 may determine the number of frequency changes from the intermediate refresh rate to the target refresh rate to reduce the perceptibility of changes in brightness and color, while realizing the target refresh rate within a reasonable amount of time.

Figure 7:
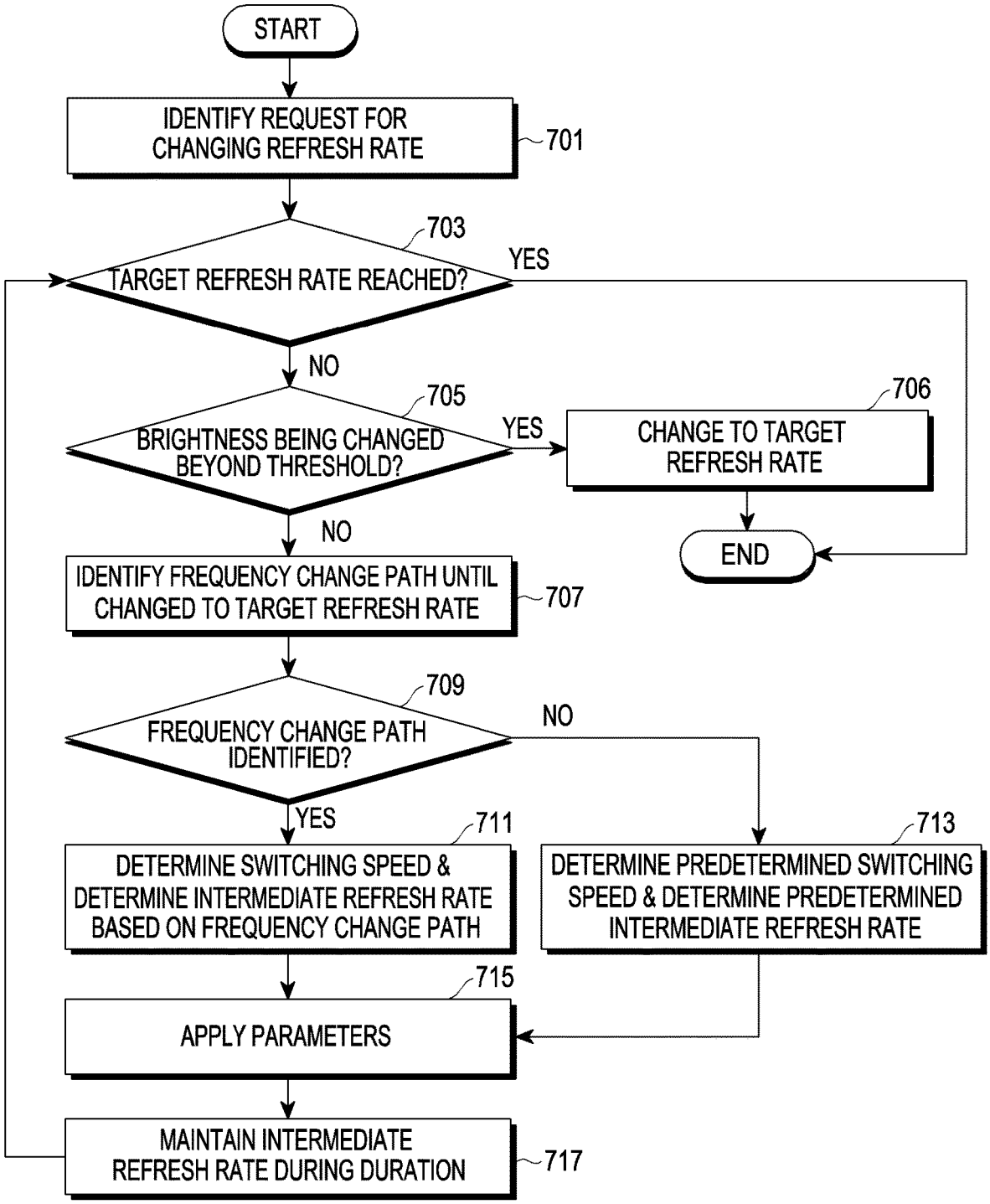
FIG. 7 is a flowchart illustrating the operation of changing a refresh rate by an electronic device according to an embodiment.

FIG. 7 is a flowchart illustrating the operation of changing a refresh rate by an electronic device according to an embodiment.

Referring to FIG. 7, in operation 701, an electronic device (e.g., the electronic device 301 of FIG. 3) may identify a request for changing the refresh rate of a display (e.g., the display 360 of FIG. 3). The electronic device 301 may identify a target refresh rate corresponding to the change request.

In operation 703, the electronic device 301 may compare the current refresh rate and the target refresh rate, and determine whether the current refresh rate has reached the target refresh rate. For example, when the current refresh rate is the same as the target refresh rate, the electronic device 301 may determine that the target refresh rate has been reached. When the current refresh rate is the same as the target refresh rate (yes in 703), the electronic device 301 may not change the refresh rate of the display 360.

In operation 705, when the current refresh rate is not the same as the target refresh rate (no in 703), the electronic device 301 may identify whether the screen brightness of the current display 360 is being changed beyond a predetermined threshold.

When the screen brightness of the display 360 is currently being changed beyond the predetermined threshold (yes in 705), the electronic device 301 may immediately change the refresh rate of the display 360 to the target refresh rate in operation 706. Even when the screen of the display 360 is currently being switched, the electronic device 301 may change the refresh rate of the display 360 directly to the target refresh rate.

In operation 707, the electronic device 301 may identify a frequency change path from the current refresh rate to the target refresh rate. The electronic device 301 may identify a frequency change path among a plurality of frequency change paths stored in a lookup table (e.g., the lookup table 440 of FIG. 4) based on the current refresh rate and the target refresh rate.

When the frequency change path is identified (yes in operation 709), the electronic device 301 may determine a switching speed in operation 711. For example, the electronic device 301 may determine the switching speed in consideration of a reduction in brightness difference and responsiveness. For example, the switching speed may refer to a speed at which a switch to the target refresh rate is made. For example, when the switching speed is higher, the electronic device 301 may undergo fewer frequency changes until it is changed to the target refresh rate is done. When the switching speed is lower, the electronic device 301 may undergo more frequency changes until it is changed to the target refresh rate. The electronic device 301 may determine an intermediate refresh rate based on the frequency change path. In this case, the electronic device 301 may determine that any one of the frequencies included in the frequency change path is the intermediate refresh rate in consideration of the switching speed.

When the frequency change path is not identified (no in operation 709), the electronic device 301 may determine a predetermined switching speed in operation 713. The electronic device 301 may determine a predetermined intermediate refresh rate based on the predetermined switching speed. For example, the predetermined intermediate refresh rate may have more or less frequencies than those of the target refresh rate. In this case, the predetermined switching speed and the predetermined intermediate refresh rate may be automatically set by a processor (processor 320 of FIG. 3) or may be set by the user.

In operation 715, the electronic device 301 may apply parameters for the intermediate refresh rate. For example, the parameters may include a timing parameter for adjusting a refresh rate, a parameter for the brightness of the display 360, and a parameter for the duration of the intermediate refresh rate.

In operation 717, the electronic device 301 may maintain the intermediate refresh rate during the duration. For example, the electronic device 301 may scan a frame at the intermediate refresh rate during the duration. When the duration elapses, the electronic device 301 may identify whether the current refresh rate reaches the target refresh rate, and resume the above-described operations according to the result of the identification.

Figure 8A:
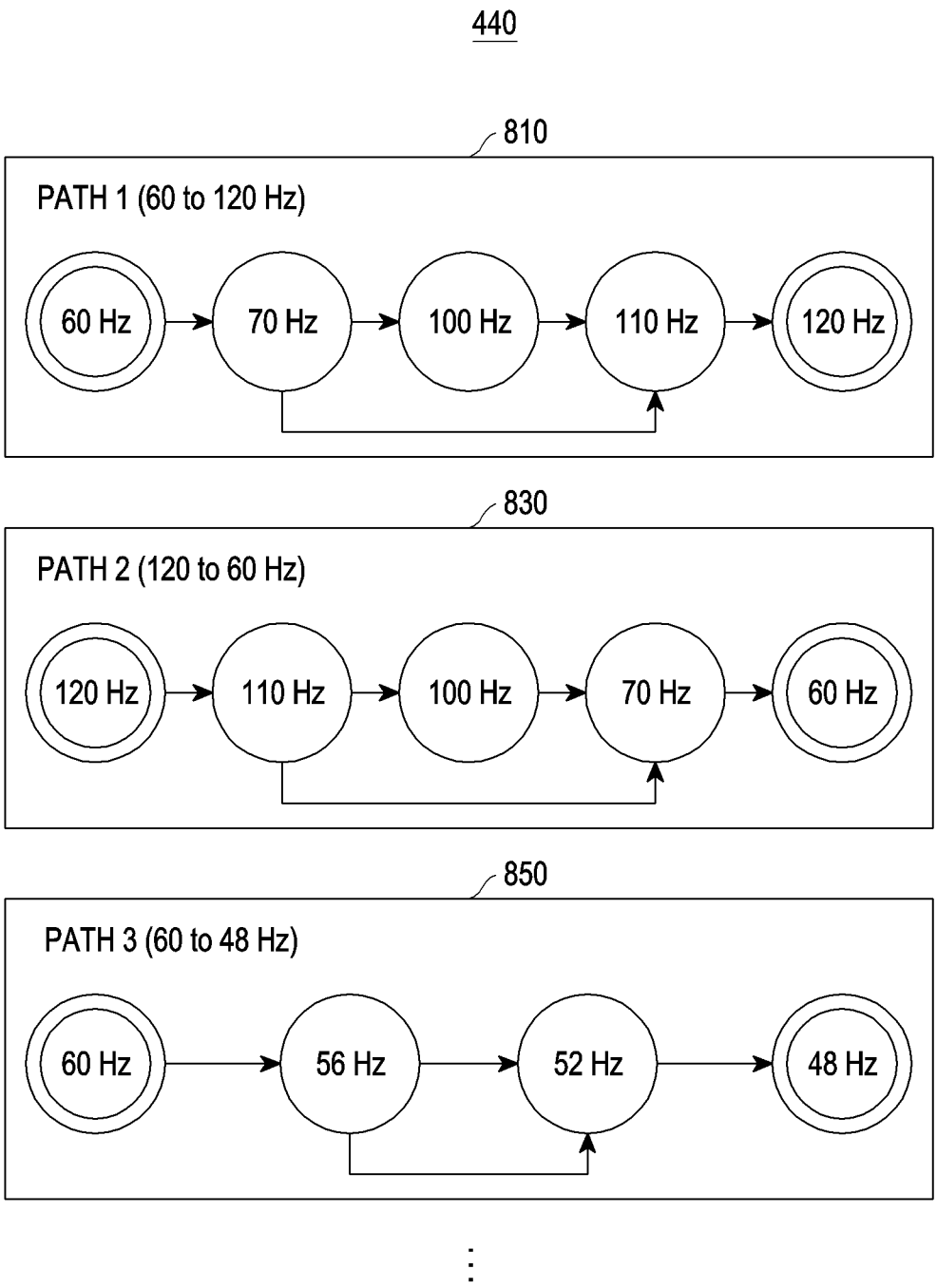
FIGS. 8A and 8B are views illustrating information about a frequency change path for changing a refresh rate by an electronic device according to an embodiment.
Figure 8B:
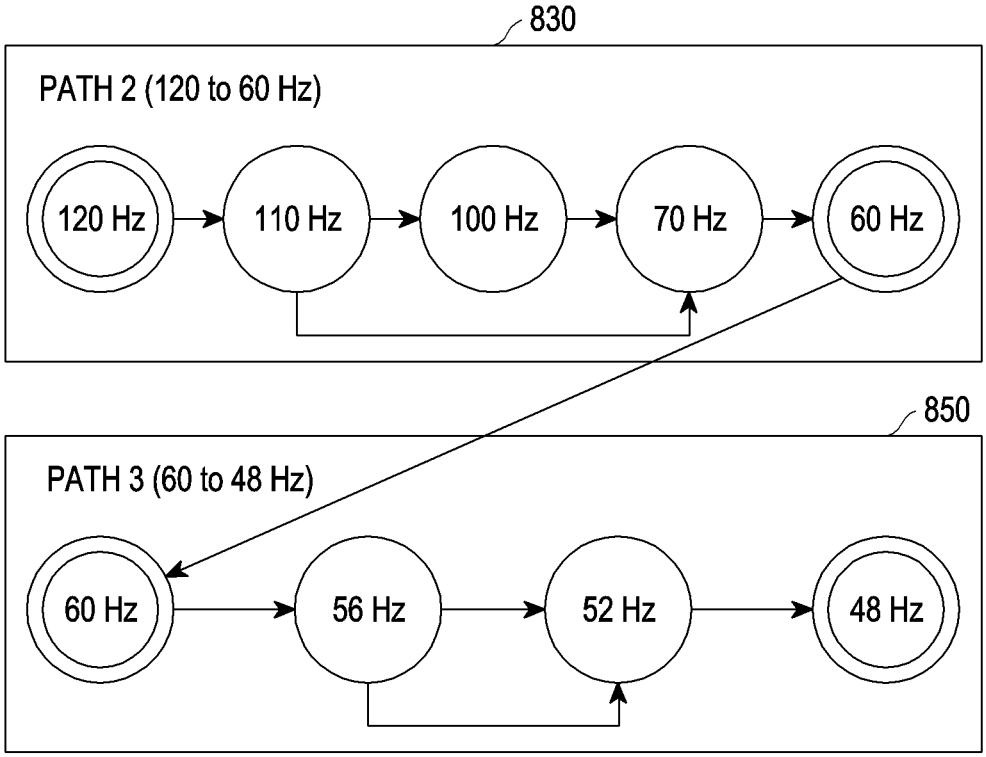

FIGS. 8A and 8B are views illustrating information about a frequency change path for changing a refresh rate by an electronic device according to an embodiment.

Referring to FIG. 8A, a lookup table 440 may include a plurality of frequency change paths (e.g., 810, 830, and 850). In certain embodiments, the frequency change path can be a data structure stored in memory. The data structure includes a sequence of refresh rates from an initial refresh rate to a target refresh rate.

The frequency change path may include intermediate refresh rates that may be undergone from an initial refresh rate to a target refresh rate. For example, a first path 810 may be a frequency change path in which the initial refresh rate is "60 Hz" and the target refresh rate is "120 Hz". A second path 830 may be a frequency change path in which the initial refresh rate is "120 Hz" and the target refresh rate is "60 Hz". A third path 850 may be a frequency change path in which the initial refresh rate is "60 Hz" and the target refresh rate is "48 Hz".

When the initial refresh rate is "60 Hz" and the target refresh rate is "120 Hz", the electronic device (e.g., the electronic device 301 of FIG. 3) may undergo a frequency change to at least one of "70 Hz", "100 Hz", and "110 Hz" until it changes to the target refresh rate, i.e., "120 Hz". For example, the electronic device 301 may change the refresh rate from 60 Hz to 70 Hz, 100 Hz, 110 Hz, and 120 Hz in response to a request for changing the refresh rate. Alternatively, the electronic device 301 may change the refresh rate from 60 Hz to 70 Hz, 110 Hz, and 120 Hz based on the switching speed.

When the target refresh rate is newly changed while the frequency is changed from the initial refresh rate to the target refresh rate, the electronic device 301 does not complete the change to the previous target refresh rate, but may identify the frequency change path for the newly changed target refresh rate. For example, when the target refresh rate is changed to "240 Hz" with the current refresh rate changed to "100 Hz" according to the first path 810, the electronic device 320 does not change the frequency to "120 Hz" but may identify a new frequency change path to change the frequency from "100 Hz" to "240 Hz".

Referring to FIG. 8B, when a switch between a plurality of paths is possible, the electronic device 301 may change the frequency between the plurality of paths. For example, the electronic device 301 may change the refresh rate from "120 Hz" to "60 Hz" and then from 60 Hz to 48 Hz through the second path 830 in response to a request for changing the refresh rate from "120 Hz" to "48 Hz". In this case, at least one of the intermediate frequencies included in the second path 830 and the intermediate frequencies included in the third path 850 may be selected as the intermediate frequency.

Figure 9:
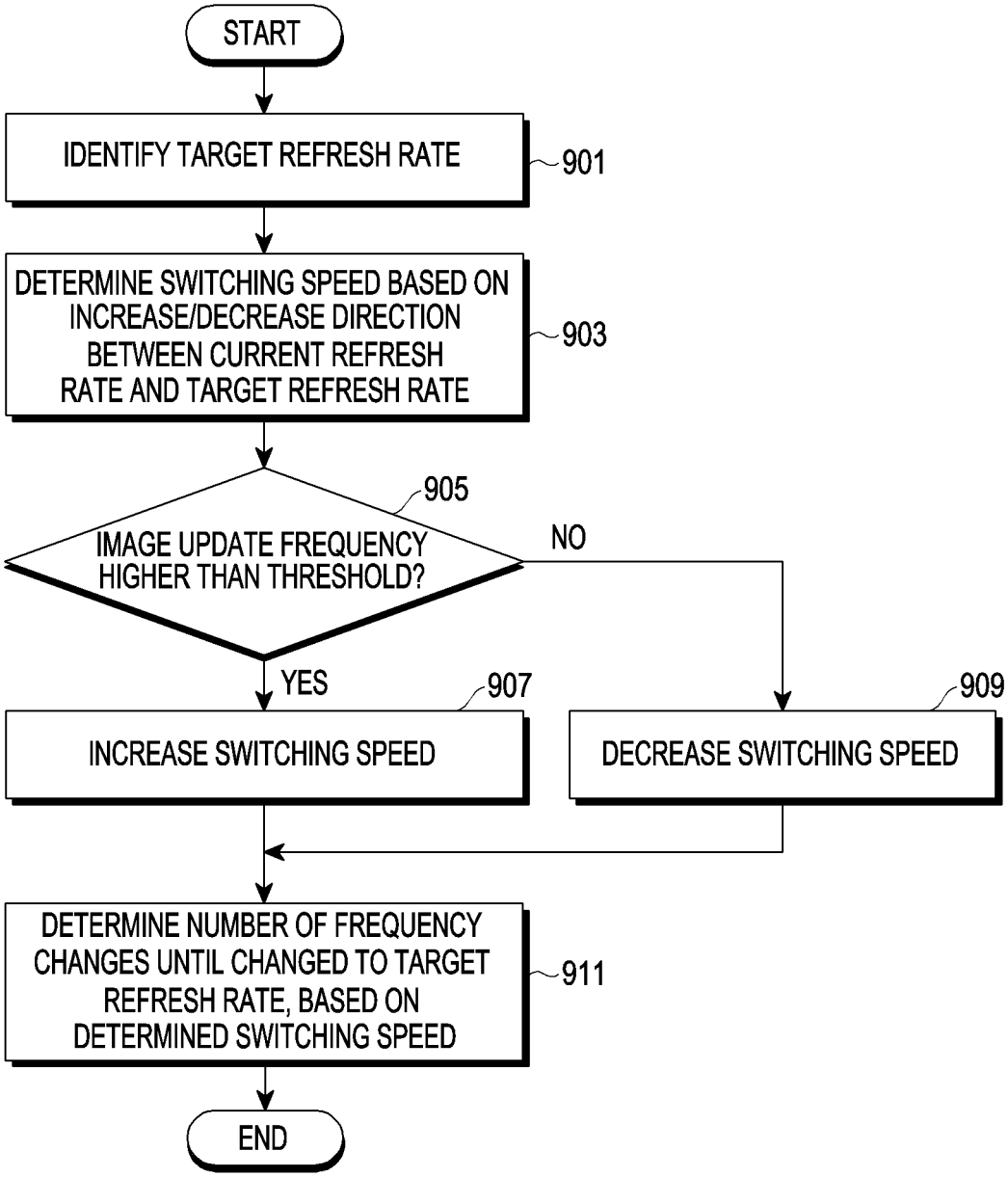
FIG. 9 is a flowchart illustrating the operation of determining a speed of switching to a target refresh rate by an electronic device according to an embodiment.

FIG. 9 is a flowchart illustrating the operation of determining a speed of switching to a target refresh rate by an electronic device according to an embodiment.

Referring to FIG. 9, according to certain embodiments, in operation 901, the electronic device (the electronic device 301 of FIG. 3) may identify a target refresh rate in response to detecting a condition for changing the refresh rate.

In operation 903, the electronic device 301 may determine a switching speed based on an increase/decrease direction between the current refresh rate and the target refresh rate. For example, when the target refresh rate higher than the current refresh rate, the electronic device 301 may increase the speed of switching to the target refresh rate. For example, when the target refresh rate is higher than the current refresh rate, the electronic device 301 may determine that the responsiveness is prioritized. In contrast, when the target refresh rate is lower than the current refresh rate, the electronic device 301 may decrease the speed of switching to the target refresh rate. For example, when the target refresh rate is lower than the current refresh rate, the electronic device 301 may determine that the difference in brightness is prioritized.

In operation 905, the electronic device 301 may identify whether the frequency of image (or screen) update is higher than a predetermined threshold, such as an empirically determined average rate of screen update in typical usage of the electronic device. For example, in a still-screen state, the electronic device 301 may determine that the frequency of image update is low. The electronic device 301 may determine that the frequency of image update is high when the screen is frequently updated, such as on a game application.

In operation 907, when the frequency of image update is higher than the predetermined threshold (yes in operation 905), the electronic device 301 may increase the speed of switching to the target refresh rate. For example, when the frequency of image update is high, the electronic device 301 may determine that the responsiveness is prioritized.

In operation 909, unless the frequency of image update is higher than the predetermined threshold (no in operation 905), the electronic device 301 may decrease the speed of switching to the target refresh rate. For example, when the frequency of image update is not higher than the predetermined threshold, the electronic device 301 may determine that the reduction in brightness difference is prioritized.

In operation 911, the electronic device 301 may determine the number of intermediate frequency changes until the target refresh rate is reached based on the switching speed determined through the above-described operation. Further, the electronic device 301 may also determine the duration of each intermediate frequency based on the determined switching speed.

FIG. 10 is a view illustrating the operation of determining a speed of switching to a target refresh rate by an electronic device according to an embodiment.

Referring to FIG. 10, an electronic device (e.g., the electronic device 301 of FIG. 3) may determine the speed of switching to a target refresh rate in consideration of a reduction in brightness difference and responsiveness.

The electronic device 301 may reduce the speed of switching to the target refresh rate in the state in which the reduction in brightness difference is prioritized. For example, as the switching speed decreases, the number of the steps of subdivision to intermediate frequencies may increase. Accordingly, the electronic device 301 may select more intermediate frequencies until it is changed to the target refresh rate. As the switching speed decreases, the duration of each intermediate frequency may increase. Accordingly, the electronic device 301 may require a relatively longer time before it is changed to the target refresh rate. However, since the electronic device 301 slowly changes the refresh rates, there is less difference in brightness or color making it unlikely to be perceivable.

The electronic device 301 may increase the speed of switching to the target refresh rate in the state in which the responsiveness is prioritized. For example, as the switching speed increases, the number of the steps of subdivision to intermediate frequencies may decrease. Accordingly, the electronic device 301 may select fewer intermediate frequencies until it is changed to the target refresh rate. As the switching speed increases, the duration of each intermediate frequency may decrease. Accordingly, the electronic device 301 may require a relatively short time before it is changed to the target refresh rate. However, since the electronic device 301 rapidly changes the refresh rate, the responsiveness of the screen may increase. However, there is a greater difference in brightness that is more likely to be perceivable than when the reduction in brightness difference is prioritized.

The electronic device 301 may set weights for brightness difference reduction and responsiveness, and determine a speed of switching to an optimized target refresh rate in consideration of the set weights.

Figure 11:
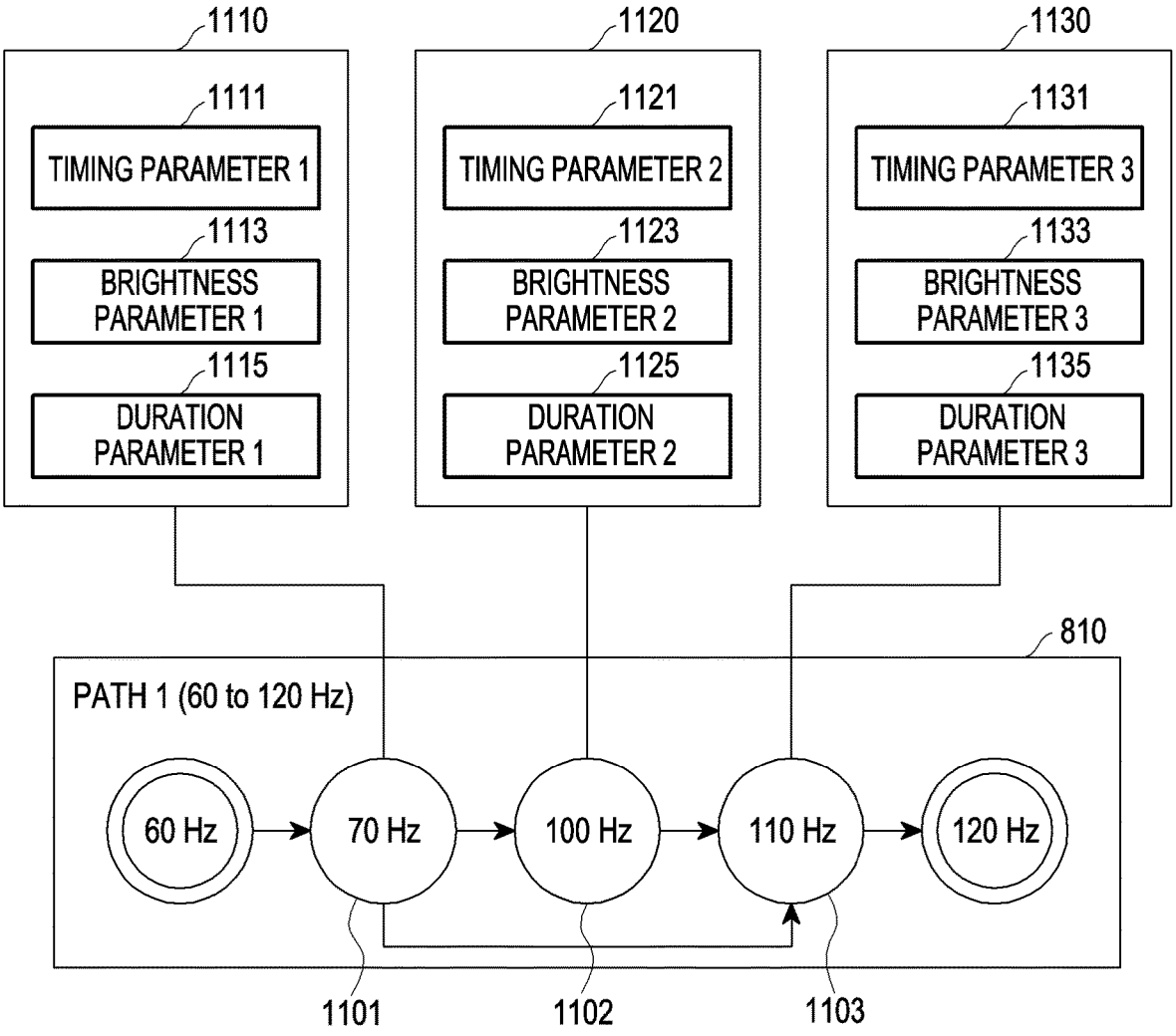
FIG. 11 is a view illustrating parameters for changing to an intermediate refresh rate according to an embodiment.

FIG. 11 is a view illustrating parameters for changing to an intermediate refresh rate according to an embodiment.

Referring to FIG. 11, a frequency change path for changing to a target refresh rate may include parameters for a plurality of intermediate frequencies. The electronic device (e.g., the electronic device 301 of FIG. 3) may change the refresh rate to a specific intermediate frequency by applying parameters for a specific intermediate frequency to a display driver IC (e.g., the display driver IC 350 of FIG. 3).

According to certain embodiments, the first path 810 may include a plurality of intermediate frequencies 1101, 1102, and 1103 from 60 Hz to 120 Hz. Each of the plurality of intermediate frequencies may include parameters for applying the corresponding intermediate frequency. For example, the parameters may include a timing parameter, a brightness parameter, and a duration parameter. For example, the timing parameter may mean a value for adjusting the V-Blank period of the frame to change the refresh rate to the corresponding intermediate frequency. The brightness parameter may be a value for compensating for the brightness of a display according to a change in refresh rate. The duration parameter may be a value for setting the duration of the refresh rate at the corresponding intermediate frequency.

According to certain embodiments, the first intermediate frequency 1101 may include first parameters 1110 for changing the refresh rate to a frequency of "70 Hz". For example, the first parameters 1110 may include a first timing parameter 1111, a first brightness parameter 1113, and a first duration parameter 1115. The first timing parameter 1111 may include a value for adjusting the V-Blank period of the frame to change the refresh rate to a frequency of "70 Hz". The first brightness parameter 1113 may include a value for compensating for the brightness of the display while changing the refresh rate to a frequency of "70 Hz". The first duration parameter 1115 may include a value indicating the duration of the refresh rate at a frequency of "70 Hz".

According to certain embodiments, the second intermediate frequency 1102 may include second parameters 1120 for changing the refresh rate to a frequency of "100 Hz". For example, the second parameters 1120 may include a second timing parameter 1121, a second brightness parameter 1123, and a second duration parameter 1125. The second timing parameter 1121 may include a value for adjusting the V-Blank period of the frame to change the refresh rate to a frequency of "100 Hz". The second brightness parameter 1123 may include a value for compensating for the brightness of the display while changing the refresh rate to a frequency of "100 Hz". The second duration parameter 1125 may include a value indicating the duration of the refresh rate at a frequency of "100 Hz".

According to certain embodiments, the third intermediate frequency 1103 may include third parameters 1130 for changing the refresh rate to a frequency of "110 Hz". For example, the third parameters 1130 may include a third timing parameter 1131, a third brightness parameter 1133, and a third duration parameter 1135. The third timing parameter 1131 may include a value for adjusting the V-Blank period of the frame to change the refresh rate to a frequency of "110 Hz". The third brightness parameter 1133 may include a value for compensating for the brightness of the display while changing the refresh rate to a frequency of "110 Hz". The third duration parameter 1135 may include a value indicating the duration of the refresh rate at a frequency of "110 Hz".

Figure 12:
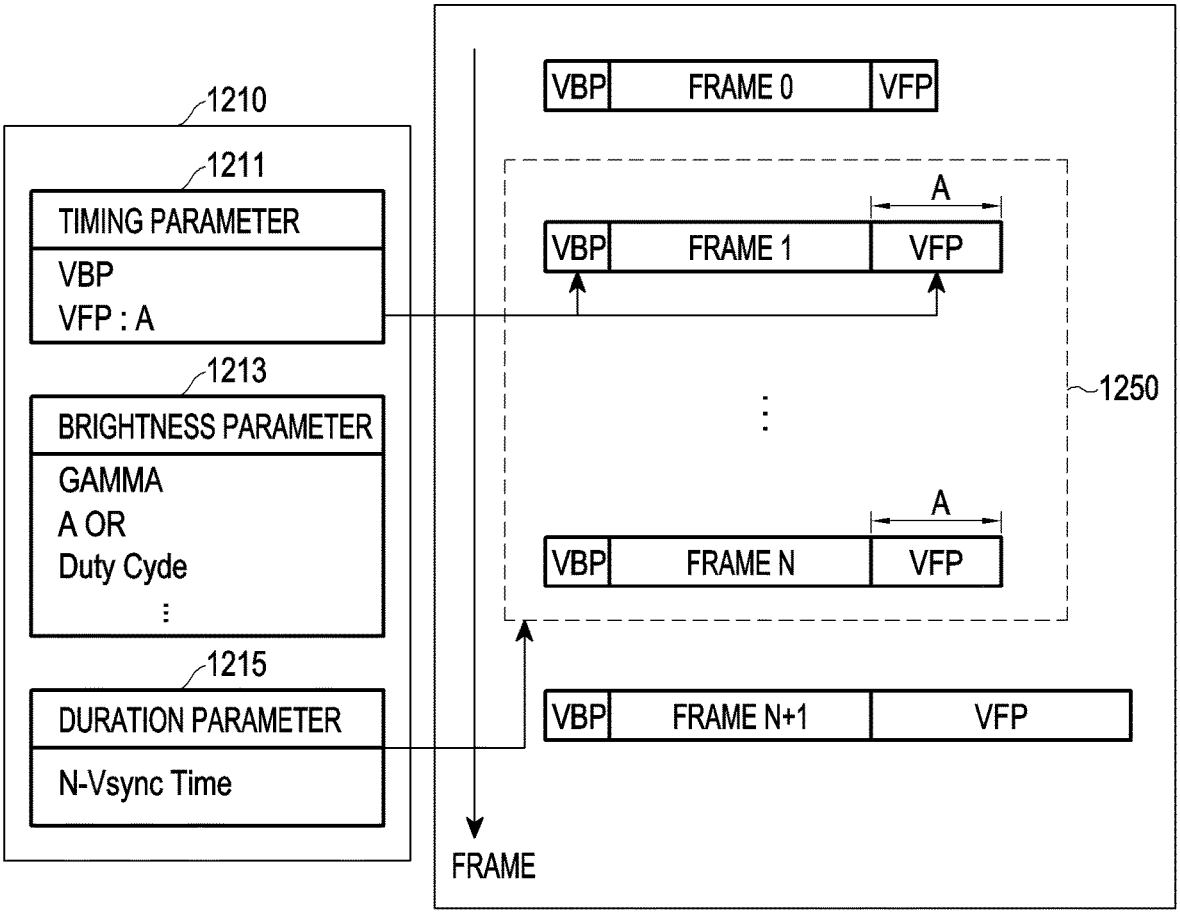
FIG. 12 is a view illustrating the operation of applying parameters for changing to an intermediate refresh rate according to an embodiment.

FIG. 12 is a view illustrating the operation of applying parameters for changing to an intermediate refresh rate according to an embodiment.

Referring to FIG. 12, in a frequency change path for changing to a target refresh rate, each of a plurality of intermediate frequencies may include parameters 1210 for changing the refresh rate to a corresponding intermediate frequency.

According to an embodiment, the electronic device (e.g., the electronic device 301 of FIG. 3) may change the refresh rate to a corresponding intermediate frequency by applying parameters 1210 for the intermediate frequency to a display driver IC (e.g., the display driver IC 350 of FIG. 3). The plurality of frames 1250 may be scanned according to the changed refresh rate. For example, the parameters 1210 may include a timing parameter 1211, a brightness parameter 1213, and a duration parameter 1215.

According to certain embodiments, when the electronic device 301 applies the timing parameter 1211 to the display driver IC 350, the vertical front porch (VFP) period of the first frame may be adjusted according to the parameter value "A". Accordingly, the refresh rate of the first frame may be changed according to the adjusted VFP period. Meanwhile, when a parameter value for adjusting a vertical back porch (VBP) period of the first frame is set in the timing parameter 1211, the VBP period of the first frame may also be adjusted according to the corresponding value.

According to certain embodiments, when the electronic device 301 applies the duration parameter 1215 to the display driver IC 350, the duration of the refresh rate changed by the timing parameter may be adjusted according to "N-Vsync time" (where N is a natural number of 1 or more). Accordingly, the refresh rate corresponding to the VFP period adjusted by the timing parameter may last from the first frame to the Nth frame (where N is a natural number greater than or equal to 2). When 'N' is 1, only the first frame may have a refresh rate corresponding to the VFP period adjusted by the timing parameter.

When the electronic device 301 applies the brightness parameter 1213 to the display driver IC 350, display brightness from the first frame to the Nth frame may be adjusted. For example, a gamma value (gamma), an aid off ratio (AOR), and a duty cycle may be adjusted.

Figure 13:
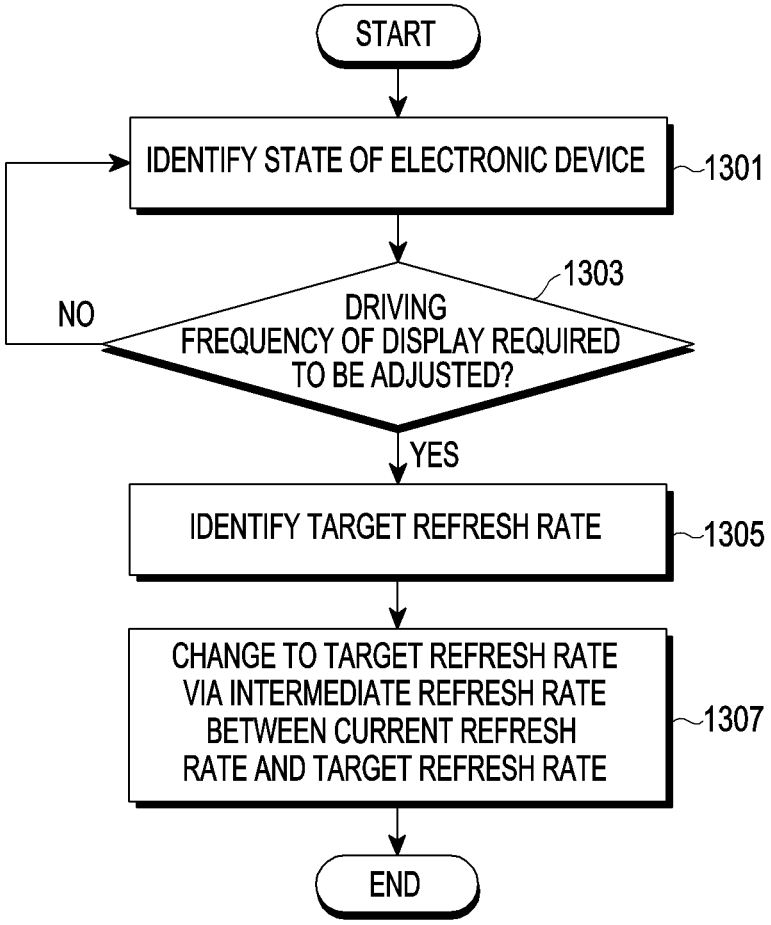
FIG. 13 is a flowchart illustrating the operation of changing a refresh rate by an electronic device according to an embodiment.

FIG. 13 is a flowchart illustrating the operation of changing a refresh rate by an electronic device according to an embodiment.

Referring to FIG. 13, in operation 1301, an electronic device (e.g., the electronic device 301 of FIG. 3) may identify the state of the electronic device 301. For example, the electronic device 301 may identify the temperature state and/or power state of the electronic device 301. The electronic device 301 may also identify whether the electronic device 301 is in the state of having no screen update (such as a still screen).

In operation 1303, the electronic device 301 may identify whether it is necessary to adjust the driving frequency of the display (e.g., the display 360 of FIG. 3) based on the state of the electronic device 301. For example, when the electronic device 301 is hot (or in excess of a predetermined temperature) or a low power state (have a battery capacity less than a predetermined percentage of the battery capacity), the electronic device 301 may determine that it is necessary to decrease the driving frequency of the display 360.

When it is determined that it is necessary to adjust the driving frequency of the display 360, the electronic device 301 may identify the target refresh rate in operation 1305. For example, the electronic device 301 may determine that the driving frequency of the display 360 to be adjusted is the target refresh rate.

According to certain embodiments, in operation 1307, the electronic device 301 may change the refresh rate of the display 360 through an intermediate refresh rate between the current refresh rate and the target refresh rate to the target refresh rate. For example, even upon decreasing the driving frequency of the display 360 due to the high temperature heat generation or low power of the electronic device 301, the electronic device 301 may change the refresh rate as the degree to which a difference in screen brightness is perceived.

Figure 14A:
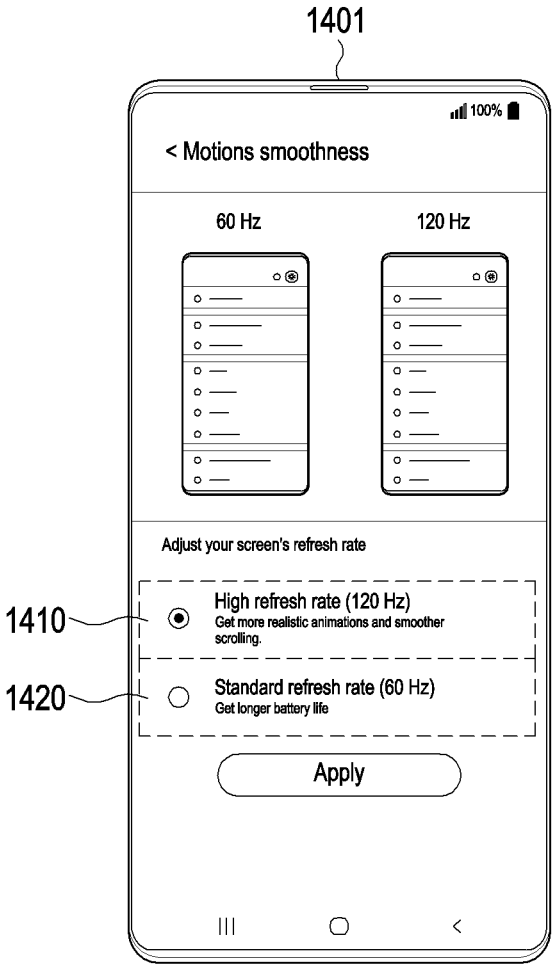
FIGS. 14A, 14B, and 14C are views illustrating the operation of changing a refresh rate by an electronic device according to an embodiment.
Figure 14B:
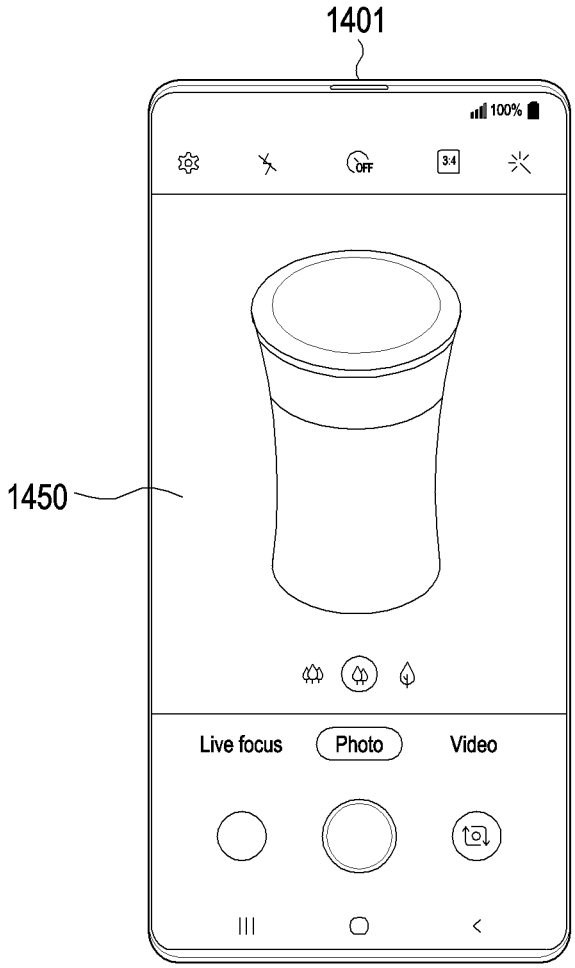
Figure 14C:
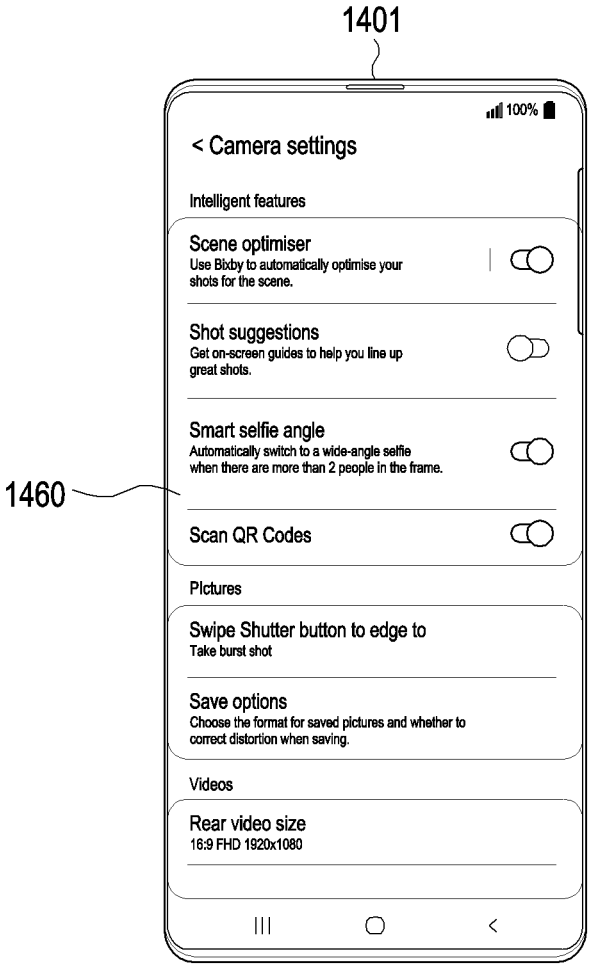

FIGS. 14A, 14B, and 14C are views illustrating the operation of changing a refresh rate by an electronic device according to an embodiment.

Referring to FIGS. 14A to 14C, an electronic device 1401 may be implemented to be substantially the same or similar to the electronic device 301 of FIG. 3.

Referring to FIG. 14A, the electronic device 1401 may display a first user interface for setting a refresh rate of a display (e.g., the display 360 of FIG. 3).

The first screen may include a first item 1410 corresponding to a "high refresh rate" and a second item 1420 corresponding to a "standard refresh rate". For example, the high refresh rate may be 120 Hz, and the standard refresh rate may be 60 Hz, which is lower than the high refresh rate.

According to various embodiments, the electronic device 1401 may display an object indicating that the first item 1410 is selected in response to a user's input (e.g., a touch input) for the first item 1410. The electronic device 1401 may display an object indicating that the second item 1420 is selected in response to a user's input (e.g., a touch input) for the second item 1420. After an object indicating that one of the first item 1410 or the second item 1420 is selected is displayed, when the user selects the "apply" object, the electronic device 1401 may set the refresh rate of the display 360 to the rate (e.g., 120 Hz) indicated by the corresponding item.

Referring to FIG. 14B, the electronic device 1401 may execute a camera application in response to a user input. For example, the camera application may identify a predetermined target refresh rate.

According to certain embodiments, the electronic device 1401 may identify a current refresh rate and a target refresh rate, and change the refresh rate of the display 360 according to the result of the identification. The electronic device 1401 may change the refresh rate of the display 360 to an intermediate refresh rate between the current refresh rate and the target refresh rate before changing to the target refresh rate. The electronic device 1401 may change the refresh rate of the display 360 from the intermediate refresh rate to the target refresh rate. Thus, the electronic device 1401 may reduce a difference in the brightness of the execution screen 1450 that occurs as the refresh rate of the display 360 is changed.

Referring to FIG. 14C, the electronic device 1401 may execute a camera application setting function in response to a user input.

The electronic device 1401 may identify a target refresh rate of the camera application setting function in response to a user input. For example, a target refresh rate predetermined for the camera application may be 60 Hz, and a target refresh rate predetermined for the camera application setting function may be 120 Hz.

The electronic device 1401 may change the refresh rate of the display 360 while the execution screen 1450 of the camera application is changed to the setting screen 1460. Before changing the current refresh rate (60 Hz) of the display 360 to the target refresh rate (120 Hz), the electronic device 1401 may change the current refresh rate (60 Hz) of the display 360 to an intermediate refresh rate having an intermediate frequency. For example, the electronic device 1401 may select an intermediate refresh rate using a first frequency change path (e.g., the first path 810 in FIG. 8) included in a lookup table (lookup table 440 in FIG. 4). For example, the electronic device 1401 may sequentially change the refresh rate of the display 360 from an initial refresh rate (60 Hz) to a plurality of intermediate refresh rates (70 Hz, 100 Hz, and 110 Hz). The electronic device 1401 may change the refresh rate of the display 360 from an intermediate refresh rate of 110 Hz to a target refresh rate of 120 Hz. The electronic device 1401 may reduce the difference in screen brightness that occurs as the refresh rate of the display 360 is changed. Accordingly, even when the refresh rate is changed, the user may not be able to perceive a significant difference in brightness between the execution screen 1450 and the setting screen 1460.

In accordance with certain embodiments, an electronic device comprises: a memory; a display; and a processor operatively connected with the memory, wherein the processor is configured to: [MD2]identify a target refresh rate and a current refresh rate of the display; and change the refresh rate of the display to a first refresh rate between the current refresh rate and the target refresh rate before changing the refresh rate of the display to the target refresh rate.

The processor may be configured to change the first refresh rate to the target refresh rate through at least one frequency changing step of changing a frequency value of the display.

The processor may be configured to determine a number of the at least one frequency changing step from the first refresh rate to the target refresh rate based on an update frequency of an image displayed on the display.

The processor may be configured to determine duration of the first refresh rate based on an update frequency of an image displayed on the display.

The processor may be configured to determine a number of the at least one frequency changing step from the first refresh rate to the target refresh rate based on an increase/decrease direction between the current refresh rate and the target refresh rate.

The processor may be configured to identify the first refresh rate based on information about a frequency change path from the current refresh rate to the target refresh rate, stored in the memory.

The processor may be configured to control the display using at least one of a timing parameter for the first refresh rate, a parameter for brightness of the display, and a parameter for duration of the first refresh rate.

The processor may be configured to, when a predetermined application is executed among a plurality of applications stored in the memory, identify a refresh rate set in the predetermined application as the target refresh rate.

The processor may be configured to identify the target refresh rate based on at least one of a temperature or a power state of the electronic device.

The processor may be configured to, when a brightness of the display is changed or a screen displayed on the display is changed, change the refresh rate from the current refresh rate to the target refresh rate without changing to the first refresh rate.

The display comprises active organic light emitting diodes.

In accordance with certain embodiments, a method for operating an electronic device comprises: [MD3]identifying a target refresh rate and a current refresh rate of a display; and changing the refresh rate of the display to a first refresh rate between the current refresh rate and the target refresh rate before changing the refresh rate of the display to the target refresh rate.

The method may further comprise changing the first refresh rate to the target refresh rate through at least one frequency changing step of changing a frequency value of the display.

The method may further comprise determining a number of the at least one frequency changing step from the first refresh rate to the target refresh rate based on an update frequency of an image displayed on the display.

The method may further comprise determining duration of the first refresh rate based on an update frequency of an image displayed on the display.

The method may further comprise determining a number of the at least one frequency changing step from the first refresh rate to the target refresh rate based on an increase/decrease direction between the current refresh rate and the target refresh rate.

Changing the refresh rate of the display to the first refresh rate may include identifying the first refresh rate based on information about a frequency change path from the current refresh rate to the target refresh rate, stored in the electronic device.

The method may further comprise, when there is no update of the image displayed on the display, identifying a predetermined target refresh rate, and changing the refresh rate to a second refresh rate between the current refresh rate and the predetermined target refresh rate before changing the refresh rate to the predetermined target refresh rate.

The method may further comprise, when a brightness of the display is changed or a screen displayed on the display is changed, changing the refresh rate from the current refresh rate to the target refresh rate without changing to the first refresh rate.

In accordance with an embodiment, an electronic device comprises a memory, a display, and a processor operatively connected with the memory. The processor is configured to identify whether a state of the electronic device is included in a condition for changing a refresh rate of the display, when the state of the electronic device is included in the change condition, identify a target refresh rate corresponding to the change condition and a current refresh rate of the display, change the refresh rate of the display to a first refresh rate between the current refresh rate and the target refresh rate, and change the first refresh rate to the target refresh rate after the refresh rate of the display is changed to the first refresh rate.

According to an embodiment, an electronic device comprises a memory, a display, and a processor operatively connected with the memory. The processor is configured to identify whether a state of the electronic device is included in a condition for changing a refresh rate of the display, when the state of the electronic device is included in the change condition, identify a target refresh rate and a current refresh rate corresponding to the change condition, change the refresh rate of the display to a first refresh rate between the current refresh rate and the target refresh rate, and change the first refresh rate to the target refresh rate after the refresh rate of the display is changed to the first refresh rate.

Each of the aforementioned components of the electronic device may include one or more parts, and a name of the part may vary with a type of the electronic device. The electronic device in accordance with certain embodiments of the disclosure may include at least one of the aforementioned components, omit some of them, or include other additional component(s). Some of the components may be combined into an entity, but the entity may perform the same functions as the components may do.

As is apparent from the foregoing description, according to certain embodiments, the electronic device may reduce the difference in screen brightness or color by changing the refresh rate of the display of the electronic device to a target refresh rate via an intermediate refresh rate.

The embodiments disclosed herein are proposed for description and understanding of the disclosed technology and does not limit the scope of the disclosure. Accordingly, the scope of the disclosure should be interpreted as including all changes or certain embodiments based on the technical spirit of the disclosure.

What is claimed is:

1. An electronic device, comprising:

a memory;

a display; and a processor operatively connected with the memory, wherein the processor is configured to:

identify whether a condition for changing a refresh rate of the display is satisfied;

based on identifying that the condition is satisfied, identify a target refresh rate and a current refresh rate of the display;

determining a switching speed for the switching to the target refresh rate, based on the target refresh rate and the current refresh rate, wherein when the target refresh rate is higher than the current refresh rate, the switching speed is faster than when target refresh rate is lower than the current refresh rate; and change the refresh rate of the display to a first refresh rate between the current refresh rate and the target refresh rate before changing the refresh rate of the display to the target refresh rate, wherein the first refresh rate is determined based on the switching speed.

2. The electronic device of claim 1, wherein the processor is configured to change the first refresh rate to the target refresh rate through at least one frequency changing step of changing a frequency value of the display.

3. The electronic device of claim 2, wherein the processor is configured to determine a number of the at least one frequency changing step from the first refresh rate to the target refresh rate based on an update frequency of an image displayed on the display and the switching speed.

4. The electronic device of claim 2, wherein the processor is configured to determine duration of the first refresh rate based on an update frequency of an image displayed on the display.

5. The electronic device of claim 2, wherein the processor is configured to determine a number of the at least one frequency changing step from the first refresh rate to the target refresh rate based on an increase/decrease direction between the current refresh rate and the target refresh rate.

6. The electronic device of claim 1, wherein the processor is configured to identify the first refresh rate based on information about a frequency change path from the current refresh rate to the target refresh rate, stored in the memory.

7. The electronic device of claim 1, wherein the processor is configured to control the display using at least one of a timing parameter for the first refresh rate, a parameter for brightness of the display, and a parameter for duration of the first refresh rate.

8. The electronic device of claim 1, wherein the processor is configured to:

when a predetermined application is executed among a plurality of applications stored in the memory, identify a refresh rate set in the predetermined application as the target refresh rate.

9. The electronic device of claim 1, wherein the processor is configured to:

identify the target refresh rate based on at least one of a temperature or a power state of the electronic device.

10. The electronic device of claim 1, wherein the processor is configured to, when a brightness of the display is changed or a screen displayed on the display is changed, change the refresh rate from the current refresh rate to the target refresh rate without changing to the first refresh rate.

11. The electronic device of claim 1, wherein the display comprises active organic light emitting diodes.

12. A method for operating an electronic device, the method comprising:

identifying whether a condition for changing a refresh rate of a display is satisfied;

based on identifying that the condition is satisfied, identifying a target refresh rate and a current refresh rate of a display;

determining a switching speed for the switching to the target refresh rate, based on the target refresh rate and the current refresh rate, wherein when the target refresh rate is higher than the current refresh rate, the switching speed is faster than when target refresh rate is lower than the current refresh rate; and changing the refresh rate of the display to a first refresh rate between the current refresh rate and the target refresh rate before changing the refresh rate of the display to the target refresh rate, wherein the first refresh rate is determined based on the switching speed.

13. The method of claim 12, further comprising changing the first refresh rate to the target refresh rate through at least one frequency changing step of changing a frequency value of the display.

14. The method of claim 13, further comprising determining a number of the at least one frequency changing step from the first refresh rate to the target refresh rate based on an update frequency of an image displayed on the display and the switching speed.

15. The method of claim 13, further comprising determining duration of the first refresh rate based on an update frequency of an image displayed on the display.

16. The method of claim 13, further comprising determining a number of the at least one frequency changing step from the first refresh rate to the target refresh rate based on an increase/decrease direction between the current refresh rate and the target refresh rate.

17. The method of claim 12, wherein changing the refresh rate of the display to the first refresh rate includes identifying the first refresh rate based on information about a frequency change path from the current refresh rate to the target refresh rate, stored in the electronic device.

18. The method of claim 12, further comprising:

when there is no update of an image displayed on the display, identifying a predetermined target refresh rate; and changing the refresh rate to a second refresh rate between the current refresh rate and the predetermined target refresh rate before changing the refresh rate to the predetermined target refresh rate.

19. The method of claim 12, further comprising, when a brightness of the display is changed or a screen displayed on the display is changed, changing the refresh rate from the current refresh rate to the target refresh rate without changing to the first refresh rate.

20. An electronic device, comprising:

a memory;

a display; and a processor operatively connected with the memory, wherein the processor is configured to:

identify whether a state of the electronic device is included in a condition for changing a refresh rate of the display;

when the state of the electronic device is included in the change condition, identify a target refresh rate corresponding to the change condition and a current refresh rate of the display;

determining a switching speed for the switching to the target refresh rate, based on the target refresh rate and the current refresh rate, wherein when the target refresh rate is higher than the current refresh rate, the switching speed is faster than when target refresh rate is lower than the current refresh rate;

change the refresh rate of the display to a first refresh rate between the current refresh rate and the target refresh rate, wherein the first refresh rate is determined based on the switching speed; and change the first refresh rate to the target refresh rate after the refresh rate of the display is changed to the first refresh rate.

* * * * *